US005176374A

United States Patent [19]

Yamada

[11] Patent Number: 5,176,374

[45] Date of Patent: Jan. 5, 1993

[54] PAPER TRANSPORTING DEVICE FOR IMAGE FORMING EQUIPMENT

[75] Inventor: Mitsuru Yamada, Yamato, Japan

[73] Assignee: Ricoh Company, Ltd., Tokyo, Japan

[21] Appl. No.: 734,913

[22] Filed: Jul. 24, 1991

Related U.S. Application Data

[63] Continuation-in-part of Ser. No. 619,770, Nov. 29, 1990, abandoned.

[30] Foreign Application Priority Data

Nov. 30, 1989 [JP] Japan ..... 1-308977
Jul. 26, 1990 [JP] Japan ..... 2-196137

[51] Int. Cl.[5] ..... B65H 3/44

[52] U.S. Cl. ..... 271/9; 271/18.1; 271/275; 198/691

[58] Field of Search ..... 271/18.1, 193, 264, 271/275, 901, 9; 198/691; 355/271, 272, 273, 374, 309; 361/225

[56] References Cited

U.S. PATENT DOCUMENTS 2,576,882 11/1951 Koole et al. ..... 198/1
3,626,620 12/1971 Kimura ..... 361/225
3,726,520 4/1973 Doi ..... 271/901 X
4,057,723 11/1977 Sarid et al. ..... 361/225 X
4,252,307 2/1981 Korte ..... 271/4
4,428,501 1/1984 Osako ..... 271/9 X

FOREIGN PATENT DOCUMENTS 2065558 7/1981 United Kingdom ..... 271/193

*Primary Examiner*—H. Grant Skaggs
*Assistant Examiner*—Carol Lynn Druzbick
*Attorney, Agent, or Firm*—Cooper & Dunham

[57] ABSTRACT

A device incorporated in image forming equipment for transporting a paper sheet fed from any one of a plurality of vertically spaced paper feeding sections along a vertically extending common transport path. The common transport path is defined by an endless dielectric belt whose volume resistivity is selected to be $10^8$ to $10^{13}$ Ω·cm. The belt transports a paper sheet upward while attracting it electrostatically thereon. A charging section implemented with a corona discharger and a counter electrode that face each other with the intermediary of the belt is located at each position where a path extending out from a particular paper feeding section merges into the common transport path.

6 Claims, 4 Drawing Sheets

PAPER TRANSPORTING DEVICE FOR IMAGE FORMING EQUIPMENT

CROSS REFERENCE TO RELATED APPLICATION

This application is a continuation-in-part of copending U.S. application Ser. No. 07/619,770, filed Nov. 29, 1990, now abandoned.

BACKGROUND OF THE INVENTION

The present invention relates to a device incorporated in image forming equipment for transporting a paper sheet and, more particularly, to a paper transporting device having a plurality of paper feeding sections arranged one above and a common vertically extending transport path for transporting a paper sheet fed from any one of the paper feeding sections vertically therealong.

Many of modern image forming equipment such as copiers, facsimile transceivers and printers have a plurality of paper feeding sections each being loaded with paper sheets of particular size. In this type of equipment, a paper sheet fed from any one of the paper feeding sections is transported along a predetermined transport path to an image transfer station, so that a toner image formed on a photoconductive element may be transferred to the paper sheet. The space available in such equipment is becoming smaller and smaller due to the increasing demand for a miniature configuration. In light of this, Japanese Utility Model Laid-Open Publication No. 78629/1989, for example, discloses a paper transport arrangement wherein a single common transport path extends vertically upward to feed all the paper sheets fed from individual paper feeding sections to an image transfer station therealong. This arrangement has a plurality of transport rollers made of rubber and positioned along the vertical transport path at intervals which are smaller than the minimum paper size as measured in the intended direction of transport. Guide members each guides a paper sheet between nearby ones of the transport rollers. The transport rollers are driven by an exclusive drive mechanism. A drawback with this conventional arrangement is, however, that the coefficient of friction of the transport rollers made of rubber changes due to aging and thereby causes paper sheets to slip on the rollers. To eliminate such slippage, a pressure of 1 kgf to 3 kgf is constantly applied to the individual transport rollers. When the length of the transport path and, therefore, the number of transport rollers increases, such pressures act on the drive mechanism as heavy loads. Another drawback is that when a paper sheet is curled due to humid environment, it is often caught by the gap between the transport roller and guide plate which neighbor each other, jamming the transport path.

Generally, the transport of a paper sheet using a transport roller relies on the coefficient of friction of the roller surface, the pressure which the roller exerts on a paper sheet, the surface hardness of the roller which is made of rubber, etc. Since the area over which the roller and paper sheet can contact each other is limited, the paper sheet is apt to slip on the roller when a load acts on the paper sheet in the opposite direction to the transport direction. To eliminate this problem, it has been customary to locate a register roller in front of a paper sheet and to cause a paper sheet to abut against a rubber roller which is biased by a substantial pressure.

Specifically, a paper sheet is caused to warp on abutting against such a rubber roller to correct a skew and is then driven by the register roller at a particular timing matching the operation of an image transfer device. This kind of implementation may achieve a satisfactory paper transport ability in the initial stage of use. However, the surface of the rubber roller sequentially wears to reduce the coefficient of friction as well as the diameter thereof. This, coupled with the fact that paper dust deposited on the roller surface reduces the contact area of the roller surface and paper sheet, critically lowers the paper transport ability.

SUMMARY OF THE INVENTION

It is therefore an object of the present invention to provide a paper transporting device for image forming equipment which surely and stably transports paper sheets fed out from any one of a plurality of vertically spaced paper feeding sections along a common vertically extending transport path.

It is another object of the present invention to provide a paper transporting device for image forming equipment capable of transporting paper sheets stably over a long period of time without exerting any noticeable load on a drive mechanism.

It is another object of the present invention to provide a paper transporting device for image forming equipment which eliminates paper jams ascribable to the changes in ambient conditions.

It is another object of the present invention to provide a paper transporting device for image forming equipment which reduces the cost by reducing the required number of component parts and elements.

It is another object of the present invention to provide a paper transporting device for image forming equipment which transports a paper sheet at a desired speed.

It is another object of the present invention to provide a generally improved paper transporting device for image forming equipment.

In accordance with the present invention, a device incorporated in image forming equipment for transporting vertically a paper sheet fed from any one of a plurality of paper feeding sections which are arranged one above another comprises an endless dielectric belt defining a common transport path for transporting vertically paper sheets which are selectively fed from the plurality of paper feeding sections, and a plurality of charging sections each for charging the belt at a particular position where paper sheets fed from one of the paper feeding sections are guided onto the common transport path.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

In illustrative embodiments which will be described, image forming equipment is implemented as an electrophotographic copier by way of example. The copier is assumed to have an endless dielectric belt for transporting a paper sheet fed out from any one of a plurality of vertically spaced paper feeding sections while attracting it electrostatically thereonto. The dielectric belt extends vertically to drive a paper sheet from a lower portion to an upper portion of the copier.

Figure 1:
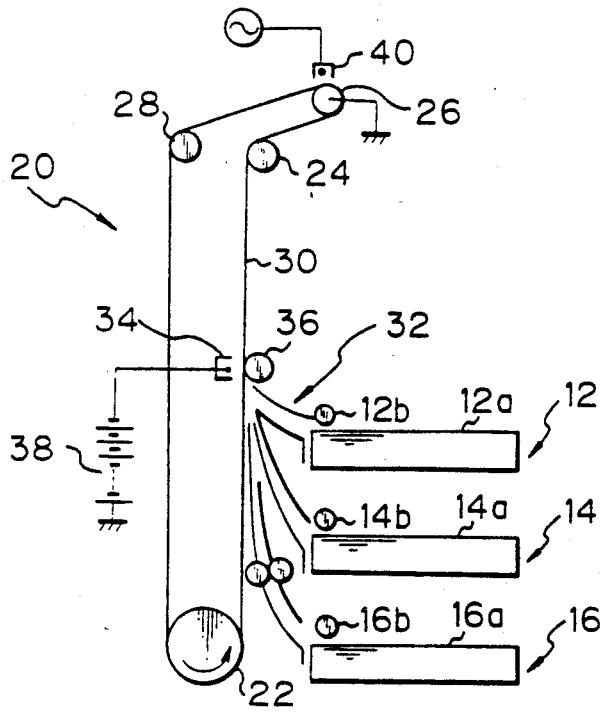
FIG. 1 is a section showing a first embodiment of the paper transporting device in accordance with the present invention.

Referring to FIG. 1 of the drawings, a first embodiment of the paper transporting device in accordance with the present invention is shown and generally designated by the reference numeral 20. As shown, the device 20 is incorporated in a copier having paper feeding sections 12, 14 and 16 which have respectively paper cassettes 12*a*, 14*a* and 16*a*, and pick-up rollers 12*b*, 14*b* and 16*b*. The device has a drive roller 22, driven rollers 24, 26 and 28, and a dielectric belt 30 passed over the rollers 22 and 24 to 28. The belt 30 has a vertical extension, no numeral, part of which defines a junction 32 where the paths extending from the individual paper feeding sections 12, 14 and 16 join. A corona discharger 38 and a counter electrode 36 face each other with the intermediary of the belt 30 in the vicinity of the junction 32. The corona discharger is connected to a high-tension power source 38 while the counter electrode 36 is connected to ground and implemented as a metallic roller. A discharger 40 is located in close proximity to the drive roller 26 having a relatively small curvature. A paper sheet coming out of the junction 32 is attracted and transported by the belt 30 which has been charged by the corona discharger 34. At the position where the driven roller 26 is located, the paper sheet is discharged by the discharger 49 and thereby separated from the belt 30 to advance to a step which follows.

As stated above, the illustrative embodiment causes the belt 30 to transport a paper sheet fed from any one of the paper feeding section 12, 14 and 16 while attracting it electrostatically at the junction 32.

Figure 2:
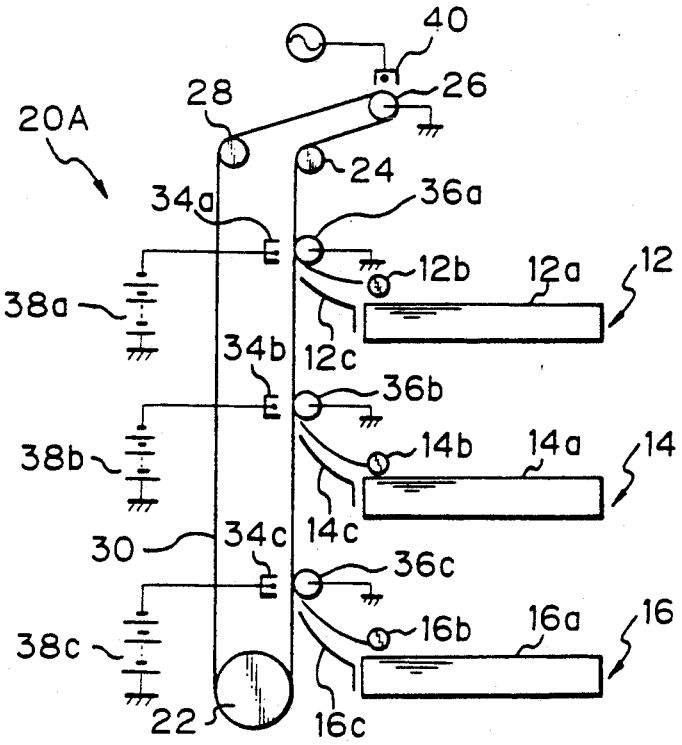
FIG. 2 is a section showing a second embodiment of the present invention.

A second embodiment of the present invention will be described with reference to FIG. 2. In the figures, the same or similar parts and elements are designated by like reference numerals, and redundant description will be avoided for simplicity. As shown, the paper transporting device, generally 20A, has independent guides 12*c*, 14*c* and 16*c* associated with the paper feeding sections 12, 14 and 16, respectively. A corona discharger 34*a* and a counter electrode 36*a*, a corona discharger 34*b* and a counter electrode 36*b*, and a corona discharger 34*c* and a counter electrode 36*c* are respectively located in the vicinity of the guides 12*c*, 14*c* and 16*c*, each in the same positional relation as in the first embodiment. The corona dischargers 34*a*, 34*b* and 34*c* are respectively connected to exclusive high-tension power sources 38*a*, 38*b* and 38*c*, so that they may be individually controlled in synchronism with the movement of the paper sheet.

Figure 3:
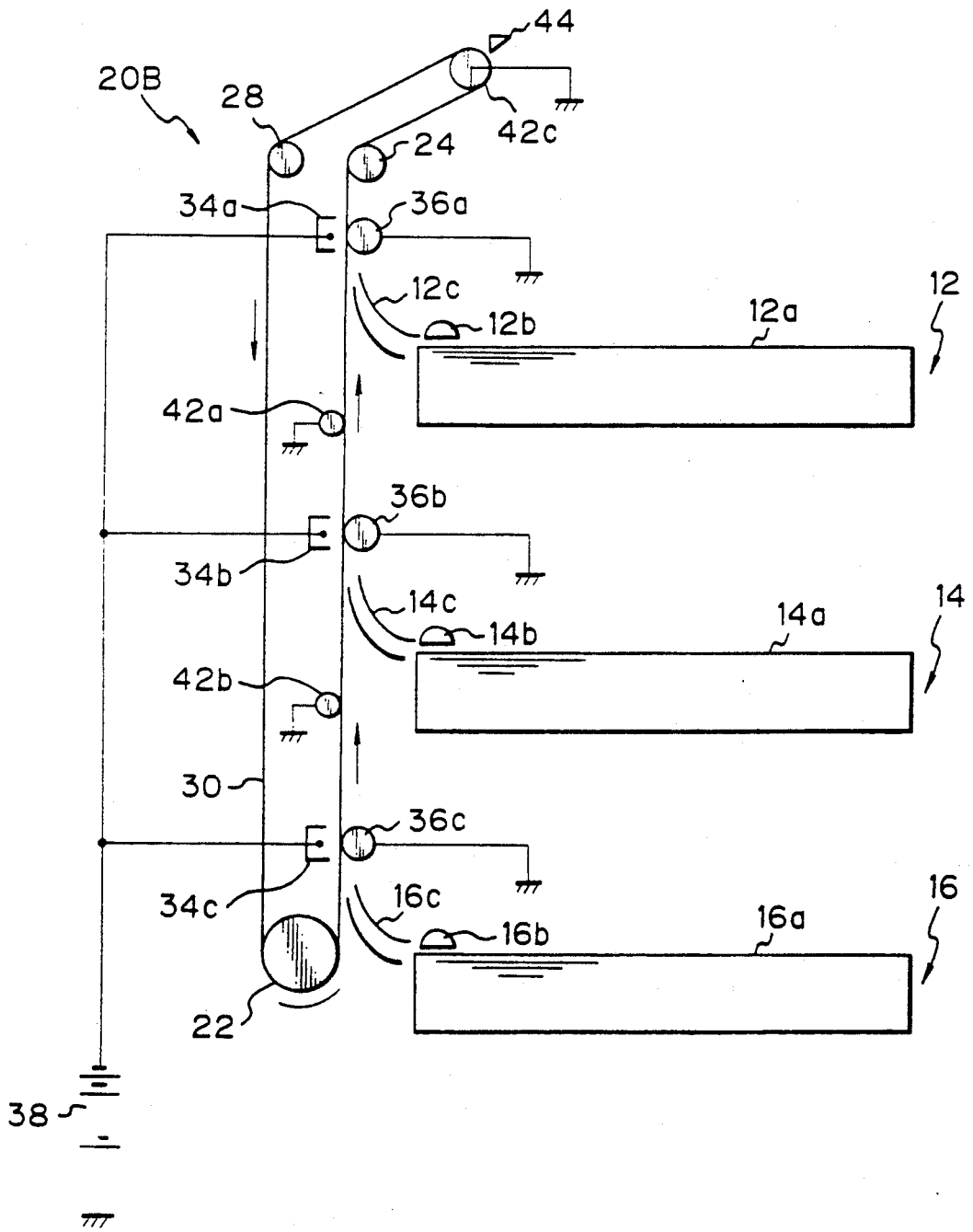
FIG. 3 is a section showing a third embodiment of the present invention.

Referring to FIG. 3, a third embodiment of the present invention will be described. In the figures, the same or similar parts and elements are designated by like reference numerals, and redundant description will be avoided for simplicity. As shown, the paper transporting device, generally 20B, has metallic rollers 42*a*, 42*b* and 42*c* in addition to the corona dischargers 34*a*, 34*b* and 34*c* which are associated with the guides 12*c*, 14*c* and 16*c*, respectively. Specifically, the metallic rollers 42*a*, 42*b* and 42*c* are connected to ground and respectively located between the corona dischargers 34*a* and 34*b*, between the corona dischargers 34*b* and 34*c*, and between the corona dischargers 34*c* and 34*a* with respect to an intended direction of movement of the belt 30 which is indicated by arrows in the figure. The rollers, or grounding members, 42*a*, 42*b* and 42*c* each is held in contact with the inner surface of the belt 30. The roller 42*c* additionally plays the role of a driven roller over which the belt 30 is passed. The diameter of the roller 42*c* is selected to be as small as about 12 mm, so that a paper sheet may be separated from the belt 30 there. A separator in the form of a pawl 44 is located near the outer periphery of the roller 42*c*. In this embodiment, the belt 30 is made of rubber having a volume resistivity ranging from $10^8$ to $10^{13}\Omega\cdot$cm and a thickness of about 0.6 mm and is wider than the maximum paper size usable with the copier. Also, in the illustrative embodiment, the drive roller 22 for driving the belt 30 is made of ozone-resistive EPDM rubber and driven in a direction indicated by an arrow in the figure. The corona dischargers 34*a*, 34*b* and 34*c* are connected to a single high-tension power source 38.

In operation, when a paper sheet fed out from any one of the paper feeding sections 12, 14 and 16 arrives, the high-tension power source 38 feeds a current to all of the corona dischargers 34*a*, 34*b* and 34*c* at a predetermined time. As a result, the corona dischargers 34*a*, 34*b* and 34*c* discharge toward their associated counter electrodes or metallic rollers 36*a*, 36*b* and 36*c* to individually charge the belt 30. Since the belt 30 constantly moves, each charged portion thereof is moved upward. However, when a paper sheet does not exist on the part of the belt 30 that has been charged by, for example, the corona discharger 34*c*, the potential of such part of the belt 30 is lowered to ground level when it reaches the metallic roller 42*b* due to the particular volume resistivity of the belt 30, i.e., $10^8$ to $10^{13}\ \Omega\cdot$cm. This is also true with the part of the belt 30 that has been charged by the corona discharger 34. Hence, the belt 30 is lowered to ground level at all of the positions where the corona dischargers 34*a*, 34*b* and 34*c* are located. In this condition, despite that the high-tension power source 34 turns on the corona dischargers 34*a*, 34*b* and 34*c* at the same time, the belt 30 is free from incomplete attraction otherwise occurring due to charge saturation thereof. When a paper sheet is fed from the paper feeding section 16, for example, the paper sheet and the belt 30 are individually polarized by the corona discharger 34*c* between the belt 30 and the counter electrode 36*c*. As a result, this paper sheet and the belt 30 move upward together while attracting each other electrostatically. Even when the paper sheet and belt 30 reach the counter electrode 36*a* which is connected to ground, the former is not effected by the latter due to the electrostatic attraction thereof. As a result, the paper sheet and belt 30 move further upward while being charged to the same polarity. Likewise, a paper sheet fed from the paper feeding section 12 passes the corona discharger 34*a* and counter electrode 36*a* and then separated from the belt 30 by the pawl 44.

The volume resistivity of the belt 30 ranging from $10^8$ to $10^{13}\Omega\cdot$cm as mentioned previously was found to be adequate by experiments. Specifically, the volume resistivity of the belt 30 was excessively low, the belt 30 failed to obtain an electrostatic capacity and, therefore sufficient attraction. Conversely, when the volume resistivity was excessively high, the discharging ability of the metallic rollers 42*a*, 42*b* and 42*c* fell to cause the potential of the belt 30 to sequentially increase until corona discharge practically failed, i.e., until a paper sheet was prevented from being polarized and attracted.

While the illustrative embodiments have been described as using corona dischargers as discharging means, they are, of course, practicable even with bias rollers, charging brushes or any other suitable charging means.

Figure 4:
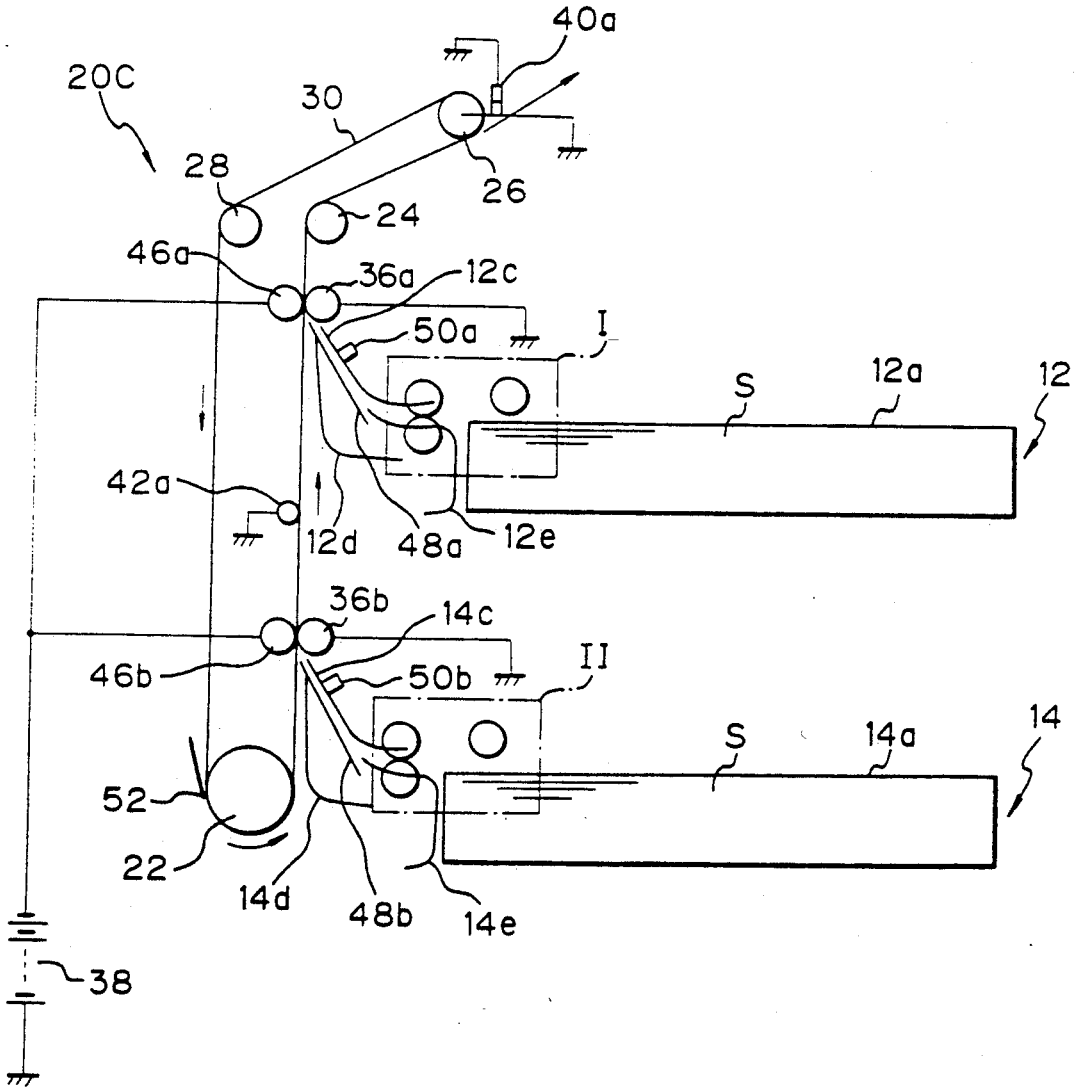
FIG. 4 is a section showing a fourth embodiment of the present invention.

Referring to FIG. 4, a fourth embodiment of the present invention is shown. In the figures, the same or similar parts and elements are designated by like reference numerals, and redundant description will be avoided for simplicity. As shown, the paper transporting device, generally 20C, has the paper feeding sections 12 and 14 which include the paper cassettes 12*a* and 14*a*, respectively. The paper cassettes 12*a* and 14*a* each is loaded with a stack of paper sheets S. The belt 30 is passed over the drive roller 22 and driven rollers 24, 26 and 28. The drive roller 22 is made of rubber having a large coefficient of friction. The driven roller 26 is made of metal and has an outside diameter as small as about 12 mm so as to readily separate the paper sheet S from the belt 30 due to the curvature thereof. The metallic roller 26 is connected to ground via the side panels of the equipment. The dielectric belt 30 is implemented as a rubber belt having a volume resistivity of $10^{10}$ to $10^{13}\Omega\cdot$cm and a thickness of 0.6 mm. The surface of the belt 30 is polished. The drive roller 22 is driven intermittently by an electromagnetic clutch, not shown.

Registration or paper separating sections I and II are respectively associated with and located in front of the paper feeding sections 12 and 14 with respect to the direction of paper feed from the paper cassettes 12*a* and 14*a*. Bias rollers 46*a* and 46*b* and counter electrodes 36*a* and 36*b* in the form of rollers are located to face each other with the intermediary of the belt 30 and respectively associated with the above-mentioned registration or paper separating sections I and II. A metallic roller 42*a* is interposed between the bias rollers 46*a* and 46*b* and held in contact with the inner surface of the belt 30. The roller 42*a* is connected to ground. The bias rollers 46*a* and 46*b* each is made up of a core made of stainless steel, and a conductive rubber layer provided on the core. A DC high voltage is applied from a high-tension power source 38 to the core of each bias roller 46*a* or 46*b* at a predetermined timing. Bearing portions provided at axially opposite ends of the bias rollers 46*a* and 46*b* are made of an insulating material such as polyacetal, so that the charge may be prevented from leaking to the side panels of the equipment. The counter electrodes 36*a* and 36*b* are made of stainless steel or similar conductive material and urged against the belt 30 by springs. The bearing portions of the counter electrodes 36*a* and 36*b* are made of highly conductive metal such as steel-based sintered metal and connected to ground.

An upper guide plate 12*c* and a lower guide plate 12*d* extend between the registration section I and the counter electrode 36*a*. Likewise, an upper guide plate 14*c* and a lower guide plate 14*d* intervene between the registration section II and the counter electrode 36*b*. Sheets made of Mylar 48*a* and 48*b* are respectively affixed to the lower guide plates 12*d* and 14*d* at one end thereof. Reflection type sensors 50*a* and 50*b* are respectively mounted on the upper surfaces of the upper guide plates 12*c* and 14*c* so as to monitor the running condition of the paper sheets S. Guide plates 12*e* and 14*e* are respectively disposed in the gap between the upper guide 12*c* and the Mylar sheet 48*a* and the gap between the upper guide 14*c* and the Mylar sheet 48*b*. A conductive discharge brush 40*a* is located at the rear of the metallic roller 26 which defines a position for separating the paper sheet S from the belt 30, as stated earlier. Further, a polyester film 52 is held in contact with the belt 30 in the vicinity of the drive roller 22 and inclined relative to the running direction of the belt 30.

Figure 5A:
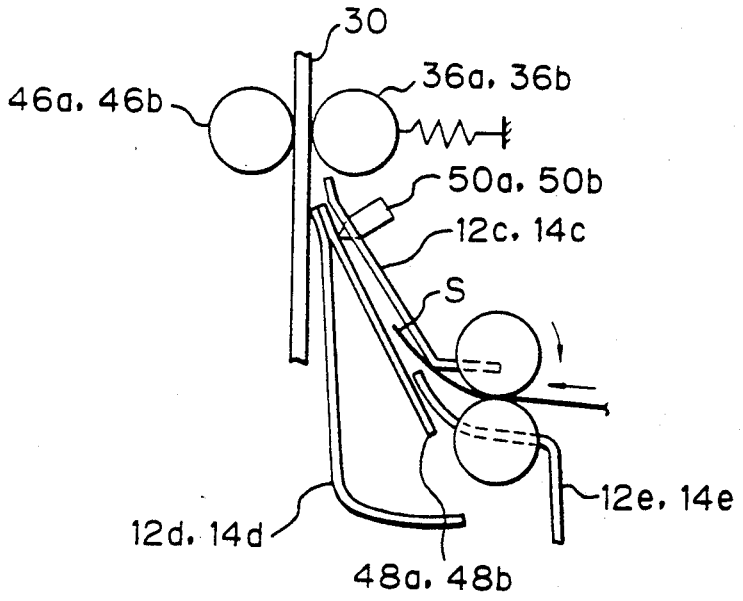
FIGS. 5A and 5B are views demonstrating the operation of the fourth embodiment.
Figure 5B:
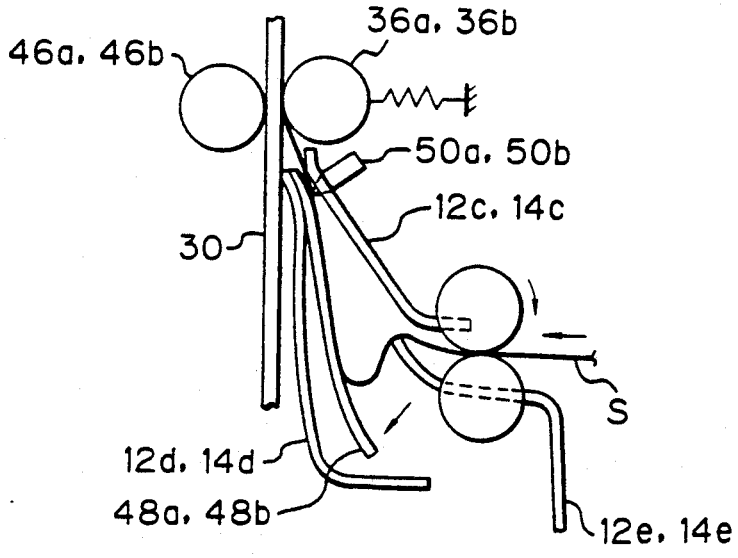

In operation, one of the paper sheets S fed from the paper cassette 12*a* or 14*a* is separated from the others by the associated registration or paper separating section I or II. As shown in FIG. 5A, the paper sheet S is guided by the Mylar sheet 48*a* or 48*b* to the belt 30. At this instant, the sensor 50*a* or 50*b* senses the leading edge of the paper sheet S. At this stage of operation, the electromagnetic clutch, not shown, is not coupled to maintain the belt 30 in a halt. Hence, the paper sheet S slides on the surface of the belt 30 whose coefficient of friction is small to reach the gap between the belt 30 and the counter electrode 36*a* or 36*b*. As shown in FIG. 5B, the counter electrodes 36*a* and 36*b* each is constantly biased by a spring toward the belt 30. Therefore, the leading edge of the paper sheet S is stopped at the inlet of the gap between the belt 30 and the counter electrode 36*a* or 36*b*. As a result, the paper sheet S is caused to warp while urging the Mylar sheet 48*a* or 48*b* downward, whereby the skew of the paper sheet S is corrected.

The above-mentioned electromagnetic clutch, not shown, is coupled at a predetermined timing after the associated sensor 50*a* or 50*b* has sensed the leading edge of the paper sheet S. At the same time, a high voltage is applied from the power source 38 to the bias roller 46*a* or 46*b* of interest. Consequently, the paper sheet S is driven to between the belt 30 and the counter electrode 36*a* or 36*b*. At the same time, an electric field is developed between the bias roller 46*a* or 46*b* and the paper sheet S with the result that electrostatic attraction occurs between the belt 30 and the paper sheet S due to polarization. The paper sheet is, therefore, transported by the electrostatic attraction and the friction of the surface of the belt 30. The drive of the paper feeding section 12 or 14 from which the paper sheet S has been fed out is interrupted when the associated sensor 50*a* or 50*b* has sensed the leading edge of the paper sheet S. Hence, despite that the above-mentioned electrostatic attraction depends on the contact area of the belt 30 and paper sheet S, the paper sheet S is successfully transported by the electrostatic attraction and the surface friction of the belt 30 since the paper feed section 12 or 14 is not driven at that time. The belt 30 transports the paper sheet S to the metallic roller 26 while retaining the paper sheet S thereon by the electrostatic attraction. At this instant, the belt 30 is driven at the same peripheral speed as the photoconductive element or drum of an image transfer device located downstream of the device 20C.

On reaching the metallic roller 26, the paper sheet S is easily separated from the belt 30 since the roller 26 has a small diameter and a large curvature, as stated previously. Then, the paper sheet S is further driven toward the image transfer device. The discharge brush 40*a* dissipates the charge remaining on the paper sheet S. Further, the polyester film 52 removes paper dust and other impurities from the surface of the belt 30 which has released the paper sheet S. Hence, the part of the belt 30 having been brought to the gap between the bias roller 46*b* and the counter electrode 36*b* again is free from impurities and allows the bias roller 46*a* to generate the electrostatic attraction with ease.

The illustrative embodiment has two vertically spaced paper cassettes, as shown and described. Alternatively, three or more paper cassettes may be arranged one above another only if the number of charging sections, the number of bias rollers and the number of counter electrodes are increased accordingly.

In summary, it will be seen that the present invention provides a paper transporting device which causes a dielectric belt to transport a paper sheet vertically while attracting it electrostatically thereonto. This eliminates a jam ascribable to a paper sheet being caught by a gap between a transport roller and a guide plate, as often occurs in a conventional device of the type using such rollers and plates. In addition, the device of the present invention exerts a minimum of load even during long distance of transport and, therefore, exhibits a stable transport ability over a long period of time. In addition, since a paper sheet in transport contacts a belt over a substantial area, it is free from noticeable slippage and skew.

Various modifications will become possible for those skilled in the art after receiving the teachings of the present disclosure without departing from the scope thereof.

What is claimed is:

1. A device incorporated in image forming equipment for transporting vertically a paper sheet fed from any one of a plurality of paper feeding sections which are arranged one above another, said device comprising:

an endless dielectric belt defining a common transport path for transporting vertically paper sheets which are selectively fed from said plurality of paper feeding sections;

a plurality of charging sections disposed for charging said belt at positions where paper sheets fed from respective ones of said paper feeding sections are guided onto said common transport path;

wherein each of said charging sections comprises a corona discharger and a counter electrode facing each other, with said belt being between the corona discharger and the counter electrode; and further comprising a plurality of grounding means each connecting said belt to ground at a position intermediate two adjacent ones of said charging sections.

2. A device as claimed in claim 1, wherein each of said grounding means comprises a conductive roller.

3. A device as claimed in claim 1, wherein said belt has a volume resistivity ranging from $10^8$ to $10^{13}\Omega\cdot$cm.

4. A device incorporated in image forming equipment for transporting vertically a paper sheet fed from any one of a plurality of paper feeding sections which are arranged one above another, said device comprising:

an endless dielectric belt defining a common transport path for transporting vertically paper sheets which are selectively fed from said plurality of paper feeding sections;

a plurality of charging sections disposed for charging said belt at positions where paper sheets fed from respective ones of said paper feeding sections are guided onto said common transport path;

wherein each of said charging sections comprises a bias roller and a counter electrode facing each other, with said belt being between the bias roller and the counter electrode; and further comprising a plurality of grounding means each connecting said belt to ground between two adjacent ones of said charging sections.

5. A device as claimed in claim 4, wherein each of said grounding means comprises a conductive roller.

6. A device as claimed in claim 4, wherein said belt has a volume resistivity of $10^{10}$ to $10^{13}\Omega\cdot$cm.

* * * * *